US007041928B2

(12) United States Patent
Nowakowski

(10) Patent No.: US 7,041,928 B2
(45) Date of Patent: May 9, 2006

(54) INTERRUPTER UNIT FOR A HIGH-VOLTAGE POWER SWITCH

(75) Inventor: Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/513,608

(22) PCT Filed: Apr. 10, 2003

(86) PCT No.: PCT/DE03/01259

§ 371 (c)(1),
(2), (4) Date: Nov. 5, 2004

(87) PCT Pub. No.: WO03/096365

PCT Pub. Date: Nov. 20, 2003

(65) Prior Publication Data

US 2005/0173378 A1 Aug. 11, 2005

(30) Foreign Application Priority Data

May 8, 2002 (DE) ..... 102 21 580

(51) Int. Cl.
*H01H 33/91* (2006.01)

(52) U.S. Cl. ..... 218/59; 218/45

(58) Field of Classification Search ..... 218/12, 218/13, 43, 45, 46, 47, 50, 51–54, 85, 90, 218/59–65, 72, 73, 80, 156–158
See application file for complete search history.

(56) References Cited

U.S. PATENT DOCUMENTS

| | | | | |
|---|---|---|---|---|
| 4,236,053 | A | 11/1980 | Sasaki et al. | |
| 5,717,183 | A * | 2/1998 | Lehmann et al. | 218/90 |
| 6,717,791 | B1 | 4/2004 | Wiesinger | |
| 6,730,871 | B1 | 5/2004 | Loebner | |

FOREIGN PATENT DOCUMENTS

| | | | |
|---|---|---|---|
| DE | 3211272 | A1 | 4/1983 |
| DE | 19832709 | A1 | 1/2000 |
| DE | 01/33594 | A1 | 5/2001 |
| DE | WO0133594 | A1 * | 10/2001 |

* cited by examiner

*Primary Examiner*—Marina Fishman
(74) *Attorney, Agent, or Firm*—Morrison & Foerster LLP

(57) ABSTRACT

An interrupter unit (1) for a high-voltage power switch supported by a supporting element (5,6) radially surrounding the interrupter element (1) and consisting of two sections (5*a*, 5*b*, 6*a*, 6*b*). The second section (5*b*, 6*b*) is radially enlarged in relation to the first section (5*a*,6*a*). A discharge opening (10,11) for a quenching gas arising during a switching process is disposed between the two sections (5*a*, 5*b*, 6*a*, 6*b*).

6 Claims, 2 Drawing Sheets covered by lids to avoid a direct radial flow of quenching gas!

INTERRUPTER UNIT FOR A HIGH-VOLTAGE POWER SWITCH

CLAIM FOR PRIORITY

This application is a national stage of PCT/DE03/1259 filed on Apr. 10, 2003, which claims the benefit of priority to DE 10221580.4, filed on May 8, 2002.

TECHNICAL FIELD OF THE INVENTION

The invention relates to an interrupter unit for a high-voltage circuit breaker.

BACKGROUND OF THE INVENTION

One such interrupter unit is known, by way of example, from Laid-Open Specification DE 32 11 272 A1. In the known arrangement, a part of the interrupter unit is held by a deflection shroud which acts as a mounting element. The deflection shroud surrounds a rated current contact piece, which is in the form of a hollow channel. A quenching gas, which is produced in the switching gap during a switching process, continues to flow through the hollow channel from the switching gap. The quenching gas is deflected on the deflection shroud, and is passed out of the interrupter unit outside the hollow channel, in the opposite direction of the flow direction of the quenching gas in the interior of the rated current contact piece. A design as this has only a relatively short outlet flow path for the quenching gas. Furthermore, the quenching gas, which is enriched with decomposition products, is passed out in the immediate vicinity of the switching gap. The webs which run from the outlet flow shroud to the rated current contact piece and to which the rated current contact piece is fitted are located directly in the outlet flow path of the quenching gas, and increase the flow resistance of this path. With the quenching gas being routed in this way, cooling and rapid onward movement of the quenching gas from the switching gap are possible only to a restricted extent.

Furthermore, FIG. 9 in U.S. Pat. No. 4,236,053 discloses an interrupter unit in which the quenching gas flowing away from the switching gap is first of all moved away from the switching gap and a labyrinth-like channel is formed by an arrangement of different outlet flow shrouds, in which the quenching gas flow direction is deflected twice through about 180°. This results in a relatively long outlet flow path for the quenching gas within a compact area. The outlet flow path there is in this case substantially formed by attaching deflection shrouds to the contact pieces, which partially support the interrupter unit. Since the contact pieces are physically designed as mechanically load-bearing elements which are surrounded by the outlet flow shrouds, this admittedly results in optimized arrangements within the interior of the outlet flow shrouds with regard to the mechanical configuration, but the outlet flow path has a high flow resistance.

SUMMARY OF THE INVENTION

The invention relates to an interrupter unit for a high-voltage circuit breaker, having two contact pieces which are arranged coaxially opposite in the longitudinal direction and form a switching gap, and having a hollow channel, which runs coaxially with respect to the contact pieces in the longitudinal direction and in whose interior a quenching gas flows along during a switching process in a first direction which continues from the switching gap, and on the outer circumference the quenching gas flows along in a second direction, which is in the opposite direction to the first direction, with at least a part of the interrupter unit being arranged in a supporting manner, coaxially with respect to the channel and surrounding it, and with the quenching gas flowing in the second direction being arranged radially, including a mounting element.

The present invention discloses the design of an interrupter unit of the type mentioned initially such that the flow path of the quenching gas from the switching gap to an outlet flow opening has a low flow resistance, while maintaining a high degree of mechanical robustness.

In the case of an interrupter unit of the type mentioned initially, according to one embodiment of the invention, the mounting element has a first section and a second section, which extends radially opposite the first section, with the second section being supported by the first section, and the at least one part of the interrupter unit being supported by the second section, and an outlet flow opening, which points in the first direction, for the quenching gas being formed between the two sections and in the area of the connection of the first and second section.

In order to achieve a quenching gas path with improved flow characteristics, components which project into it are removed from the outlet flow path. The interrupter unit is supported by an "outer casing body" by the use of a mounting element which surrounds the hollow channel and has two sections, one of which extends radially, an outlet flow opening is formed in the area in which the two sections abut. The configuration of the mounting element as an "outer casing body" creates a space in the interior of the mounting element which is free of assemblies, and which would necessarily have to be provided for mechanical retention. The internal area of the mounting element can be filled or used freely in accordance with the stated requirements for the interrupter unit. This also results in a better configuration for the outlet flow path for the quenching gas. The alignment of the outlet flow opening in the first direction, that is to say continuing from the switching gap, also ensures that the quenching gas cannot flow back directly into the area of the switching gap after flowing out of the outlet flow opening, either, where it would weaken its dielectric strength.

One advantageous embodiment can also be provided by coupling the second section to the interrupter unit in the area of a rated current contact piece. The coupling of the second section in the area of a rated current contact piece results in a very large section of one end of the interrupter unit being covered by the mounting element, starting from one end of the interrupter unit and in the longitudinal direction. A central mounting point can thus be formed in the area of the rated current contact piece, in which the entire contact system, with the rated current contact, the arc contact, the drives etc, is mounted.

The coupling may in this case be in the form of a rigid structure or else a moving structure. A moving structure can be provided, for example, for a moving rated current contact piece.

It is advantageously also possible to provide for the second section to be a part of the current path which can be interrupted by the interrupter unit.

In order to ensure sufficient mechanical robustness, the second section of the mounting element is produced from a suitable material which can at least partially support the interrupter unit. Such materials are, for example, metals, which are also electrically conductive. Particularly when the second section of the mounting element is coupled in the area of a rated current contact piece, the electric current can be transported via the second part directly to the switching gap. There is no need for any additional electrical conductors which would need to be used to supply the electric current to the contact pieces of the interrupter unit. As part of the current path to be interrupted, the second section of the mounting element also, of course, has to carry the electrical potential which drives the current. The second section is also suitable for shielding the assemblies surrounded by it.

A further advantageous embodiment provides for a field control electrode to be arranged on the mounting element, in particular on the second section.

Particularly in the end areas of the mounting element, there is a risk of high electrical field strengths occurring, since the transition to further assemblies or substances, which may possibly be at a different electrical potential, takes place in these areas. Field control electrodes can be used to control these electrical fields. In this case, the mounting element may itself be formed such that it forms a field control electrode.

A further advantageous embodiment provides for a cooling device to be arranged upstream of the outlet flow opening in the course of the flowing quenching gas.

In order to further increase the effectiveness of the long outlet flow path for the quenching gas, it is particularly advantageous to arrange a cooling device in the quenching gas flow. The cooling device reduces the temperature level of the quenching gas, thus increasing the dielectric strength of the quenching gas.

One particularly advantageous embodiment of a cooling device may in this case provide for the quenching gas to flow through a perforated metal sheet.

BRIEF DESCRIPTION OF THE DRAWINGS

The invention will be described in more detail in the following text, and is illustrated, with reference to an exemplary embodiment, in a drawing, in which.

DETAILED DESCRIPTION OF THE INVENTION

Figure 1:
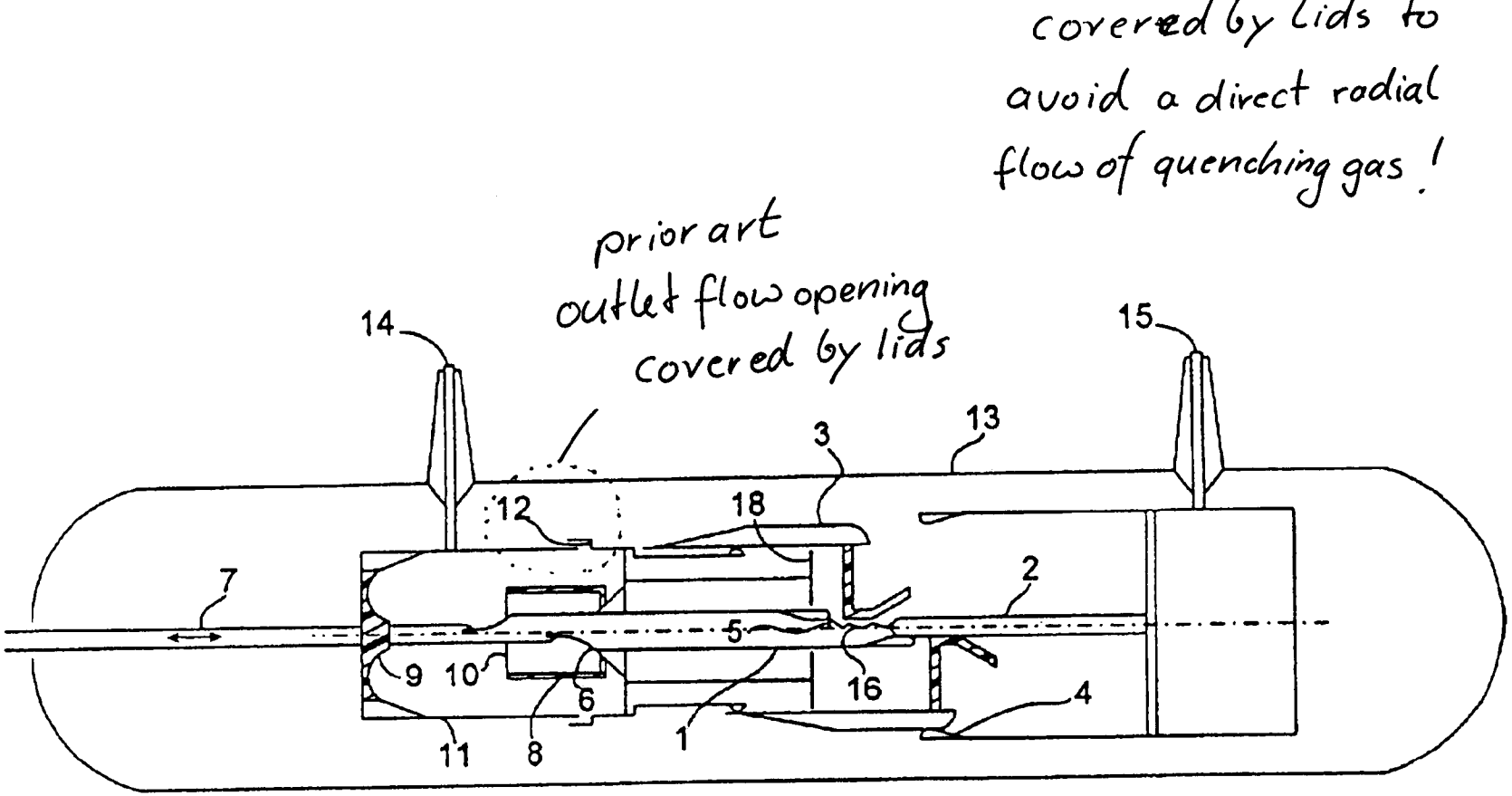
FIG. 1 shows a schematic design for an interrupter unit for a high-voltage circuit breaker.
Figure 2:
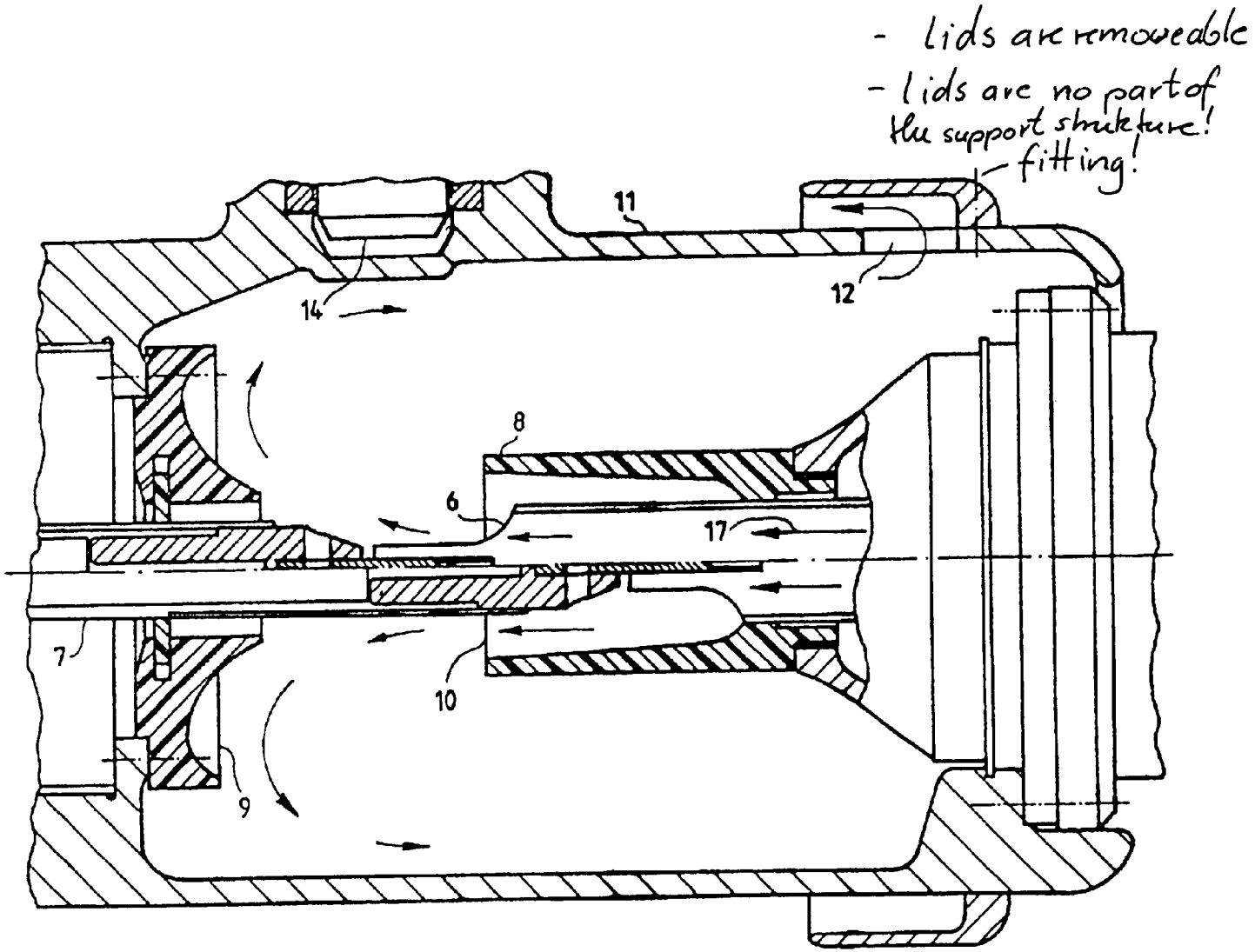

FIG. 1 shows an interrupter unit 1 for a high-voltage circuit breaker. The interrupter unit 1 is arranged within an encapsulation enclosure 23, only parts of which are illustrated in the figure. The encapsulating enclosure 23 is filled with a pressurized insulating gas, for example sulfur hexafluoride. The interrupter unit 1 has a first electrical connection 2, as well as a second electrical connection 3. the first electrical connection 2 as well as the second electrical connection 3 are used to link the interrupter unit 1 to an electrical current path, which can be interrupted or made by means of the interrupter unit 1. The first electrical connection 2 as well as the second electrical connection 3 may, for example, be passed by means of outdoor bushings through the encapsulating enclosure 23 of the high-voltage circuit breaker. The interrupter unit 1 is supported and mounted with respect to the encapsulating enclosure 23 by means of isolators 4*a*, 4*b*.

The interrupter unit 1 has a first mounting element 5 as well as a second mounting element 6. The second mounting element 6 has a flow deflection device at one end. The first mounting element 5 has a separate associated flow deflection device 7. The separate flow deflection device 7 is composed of an insulating material. The first mounting element 5 as well as the second mounting element 6 have a tubular structure, and are each formed from a first section and a second section. Furthermore, bodies whose shape is not in the form of a circular tube can also be used to form the mounting elements. The first section 5*a* of the mounting element 5 has a smaller diameter than the second section 5*b* of the first mounting element 5. The first section 6*a* of the second mounting element 6 likewise has a smaller diameter than that of the second section 6*b* of the second mounting element 6. The first section 5*a* and the second section 5*b* of the first mounting element 5 are mechanically coupled to one another in an overlapping area (see the reference symbol 8). The first section 6*a* as well as the second section 6*b* of the second mounting element are likewise mechanically connected to one another in an overlapping area (see the reference symbol 9). The mechanical attachment points 8, 9 are, for example, arranged at each of three points which are symmetrically distributed on the circumference of the mounting elements 5, 6. A first outlet flow opening 10 for quenching gas is provided between the first section 5*a* and the second section 5*b* of the first mounting element 5. A second outlet flow opening 11 for the quenching gas is provided between the first sections 6*a* and the second section 6*b*. Both the first outlet flow opening 10 and the second outlet flow opening 11 have an annular profile, interrupted by the attachment points 8, 9, around the respective first section 5*a*, 6*a*, and are in the process aligned such that the outlet flow openings 10, 11 point away from the switching gap in the interrupter unit 1. The respective first sections 5*a*, 6*a* support the respective second sections 5*b*, 6*b*. Further attachment points 12*a*, 12*b* are arranged at that end of the second section 5*b* of the first mounting element 5 which points towards the switching gap. An annular fixed contact 13 of a sliding contact arrangement is attached to the further attachment points 12*a*, 12*b*. A rated current contact piece 14 is mounted in the fixed contact 13 of the sliding contact arrangement such that it can move. A dielectric nozzle 15 is rigidly connected to the moving rated current contact piece. The dielectric nozzle 15 and the moving rated current contact piece 14 concentrically surround a moving arc contact piece 16. The moving arc contact piece 16 is tubular, and represents a hollow channel. The moving rated current contact piece 14, the moving arc contact piece 16 and the dielectric nozzle 15 are supported by the second section 5*b* of the first mounting element 5.

Further attachment points 12*c*, 12*d* are arranged at that end of the second section 6*b* of the second mounting element 6 which faces the switching gap. A stationary rated current contact piece 17 is supported by the further attachment points 12*c*, 12*d*. Furthermore, a tubular piece 18 which forms a channel is held on the further attachment points 12*c*, 12*d* with a stationary arc contact piece 19 being arranged in its interior. The stationary arc contact piece 19 projects into the dielectric nozzle 15. The moving rated current contact piece 14 and the moving arc contact piece 16 are arranged coaxially opposite the stationary rated current contact piece 17 and the stationary arc contact piece 19. The stationary rated current contact piece 17, the stationary arc contact piece 19 and the tubular piece 18 are supported by the second section 6*b* of the second mounting element 6.

The second sections 5*b*, 6*b* are rounded at those ends of the second sections 5*b*, 6*b* of the mounting elements 5, 6 which face the switching gap, where they form a respective field control electrode 5*c*, 6*c*.

An arc 24 is struck between the two arc contact pieces 16, 19 during a switching-off movement of the moving arc contact piece 16, of the moving rated current contact piece 14 and of the dielectric nozzle 15 in the direction of the arrow, which is annotated with the reference symbol 20. The thermal effect of the arc 24 results in a quenching gas being formed in the area of the switching gap formed by the arc contact pieces 16, 19, and this quenching gas flows on the one hand through the moving arc contact piece 16 and on the other hand through the tubular piece 18, as a result of the pressure increase produced by the arc 24. The moving arc contact piece 16 has openings at the end facing away from the switching gap, through which the quenching gas flows out, and strikes the separate flow deflection device 7. The quenching gas is deflected from there, and is deflected outside the moving arc contact piece 16 in the opposite direction to the direction of the flow of quenching gas in the interior of the moving arc contact piece 16. The quenching gas flows radially outwards through a radial opening 21*a* which is formed by the first section 5*a* and the second section 5*b*, and is then blown out through the first outlet flow opening 10.

The quenching gas flowing in the area of the second mounting element 6 is guided in an analogous manner. A portion of the quenching gas generated in the switching gap is passed through the tubular piece 18 from the switching gap, and strikes the deflection device of the second mounting element 6. From there, it is forced outwards along the outside of the tubular piece 18 through a radial opening 21*b* which is formed between the first section 6*a* and the second section 6*b* of the second mounting element 6. The second section 6*b* in the second mounting element 6 then results in a further reversal of the flow direction and in the quenching gas being emitted from the second outlet flow opening 11, such that the quenching gas is carried away from the switching gap. A cooling device 22 is arranged in the area of the radial opening 21*b* which is formed between the first section 6*a* and the second section 6*b* of the second mounting element 6. The cooling device 22 has a tubular structure, essentially being formed from a perforated metal sheet, through whose holes the quenching gas can pass. The quenching gas is cooled down further as it passes through the holes in the cooling device 22.

The arrows which are illustrated by means of interrupted lines in the figure symbolize the path of the quenching gas from the switching gap to the outlet flow openings 10, 11. The current path from the electrical connections 2, 3 to the arc contacts 16, 19 and to the rated current contacts 14, 17 respectively is represented by the dotted lines.

Since FIG. 1 is a schematic illustration, the outlet flow path of the quenching gas is illustrated only in principle. In particular, the separation of the quenching gas flows before and after passing through the flow deflection devices can also be achieved by further components. Furthermore, the flow resistance can be minimized by breaking off or rounding body edges.

The invention claimed is:

1. An interrupter unit for a high-voltage circuit breaker, comprising:

two contact pieces which are arranged coaxially opposite in a longitudinal direction and form a switching gap; and a hollow channel which runs coaxially with respect to the contact pieces in a longitudinal direction and in whose interior a quenching gas flows along during a switching process in a first direction which continues from the switching gap, and on an outer circumference of the channel the quenching gas flows along in a second direction, which is in an opposite direction to the first direction, with at least a part of the interrupter unit being arranged in a supporting manner, coaxially with respect to the channel and surrounding it, and with the quenching gas flowing in the second direction being arranged radially thereto, including a mounting element, which, has a first section and a second section, which extends radially opposite the first section, with the second section being supported by the first section, and the at least one part of the interrupter unit being supported by the second section, and an outlet flow opening, which points in the first direction, for the quenching gas being formed between the two sections and in an area of the connection of the first and second section.

2. The interrupter unit for a high-voltage circuit breaker as claimed in claim 1, wherein the second section is coupled to the interrupter unit in an area of a rated current contact piece.

3. The interrupter unit for a high-voltage circuit breaker as claimed in claim 1, wherein the second section is a part of a current path which can be interrupted by the interrupter unit.

4. The interrupter unit for a high-voltage circuit breaker as claimed in claim 1, wherein a field control electrode is arranged on the mounting element on the second section.

5. The interrupter unit for a high-voltage circuit breaker as claimed in claim 1, wherein a cooling device is arranged upstream of the outlet flow opening in the course of the flowing quenching gas.

6. The interrupter unit for a high-voltage circuit breaker as claimed in claim 5, wherein the cooling device has a perforated metal sheet through with the quenching gas flows.

* * * * *